US007401771B2

(12) United States Patent
Steyer

(10) Patent No.: US 7,401,771 B2
(45) Date of Patent: Jul. 22, 2008

(54) DEVICE FOR LAYING A FLEXIBLE MATERIAL WEB

(75) Inventor: Peter Steyer, Arbon (CH)

(73) Assignee: Saurer GmbH & Co. KG, Monchengladbach (DE)

( * ) Notice: Subject to any disclaimer, the term of this patent is extended or adjusted under 35 U.S.C. 154(b) by 100 days.

(21) Appl. No.: 11/405,180

(22) Filed: Apr. 17, 2006

(65) Prior Publication Data

US 2006/0255523 A1 Nov. 16, 2006

Related U.S. Application Data

(63) Continuation of application No. PCT/IB2004/003827, filed on Sep. 7, 2004.

(30) Foreign Application Priority Data

Oct. 18, 2003 (DE) ..... 103 48 529

(51) Int. Cl.
*B65H 29/46* (2006.01)

(52) U.S. Cl. ..... 270/30.01; 270/30.12; 270/30.13; 270/30.1; 270/30.4; 270/39.01; 270/39.05

(58) Field of Classification Search ..... 270/30.01, 270/30.12, 30.13, 30.1, 30.4, 39.01, 39.05; 493/413, 414, 415, 451; 19/160, 163
See application file for complete search history.

(56) References Cited

U.S. PATENT DOCUMENTS 3,917,250 A 11/1975 Branick
5,285,554 A * 2/1994 Jean et al. ..... 19/163
6,155,551 A 12/2000 Russ et al.
6,195,844 B1 * 3/2001 Jourde et al. ..... 19/163
6,949,060 B2 * 9/2005 Lenk ..... 493/424
2002/0198091 A1 12/2002 Catallo
2004/0147384 A1 * 7/2004 Lenk ..... 493/405

FOREIGN PATENT DOCUMENTS

| | | |
|---|---|---|
| DE | 34 22 352 A1 | 12/1985 |
| DE | 44 38 770 A1 | 4/1995 |
| DE | 196 44 383 C1 | 4/1998 |
| DE | 298 23 580 U1 | 11/1999 |
| DE | 101 25 452 C2 | 12/2002 |
| JP | 60 102367 | 6/1985 |
| WO | WO 98/57877 A1 | 12/1998 |

* cited by examiner

*Primary Examiner*—Gene O. Crawford
*Assistant Examiner*—Leslie Nicholson, III
(74) *Attorney, Agent, or Firm*—Alston & Bird LLP

(57) ABSTRACT

A device for laying a flexible material web 1 on a point of deposit 4 and which has at least one pair of deposit rollers 2, 3 that rotate in opposite directions. The deposit rollers 2, 3 form part of a deposit carriage 5 which is reciprocated in a reversible direction over at least the deposit length L of the material web 1. The device is more cost-effective in that the deposit carriage 5 has a smaller width than the point of deposit 4 and is reciprocated in a reversible direction over at least the deposit width B of the point of deposit 4.

20 Claims, 5 Drawing Sheets

DEVICE FOR LAYING A FLEXIBLE MATERIAL WEB

CROSS REFERENCE TO RELATED APPLICATION

The present application is a continuation of international application PCT/IB2004/003827, filed 7 Sep., 2004, and which designates the U.S. The disclosure of the referenced application is incorporated herein by reference.

BACKGROUND OF THE INVENTION

The present invention relates to a device for laying a flexible material web and having at least one pair of deposit rollers rotating in opposite directions, where the material web can be supplied to at least one point of deposit by means of the deposit rollers, where the deposit rollers are a part of the deposit carriage which can be traversed over the deposit length of the material web and with a reversible direction, where the deposit carriage has a smaller width than the point of deposit and can be traversed over the deposit width of the point of deposit and with a reversible direction.

A device of the type under discussion follows from U.S. Pat. No. 6,155,551. There a device for stacking strip-like, flexible material is described. The carriage there moves forward and back along a third frame over the deposit length and transversely, where a second frame and the third frame are moved together so that the next layer is deposited next to the previously formed layer. If the entire depositing over the length and width has taken place, the platform turns by 90° and the depositing process is done anew but on a foundation which consists of layers offset by 90°. The flexible material web arrives free and unguided at the deposit rollers. Due to this, twisting of the material web between the supply and deposit rollers can occur so that the upper side of the material web in the stack could incorrectly point downwards.

From DE 3422352 A1 a device is known for stacking an approximately flat cable to form an approximately square block. There the cable is introduced, from a source at a distance, into a drawing-in device which is mounted on a transverse carriage. The transverse carriage is mounted in the manner of a cat on a longitudinal carriage. It is significant that no transport belts are provided. The supply of the material web up to the drawing-in device is of no interest.

Furthermore, JP 60102367 discloses a device with a deposit carriage which can be traversed in the longitudinal and transverse direction, where the material web arrives from a conveyor belt freely suspended at a funnel and from there between two rollers to an exit opening. Also in the case of this device no transport belts are provided and thus no secured supply of the material web.

According to DE 101 25 452 C2 a device is known, where a material web is also guided via deposit rollers as a component of the deposit carriage to a point of deposit. There the secured transport of the material web on a transport belt has in fact already been disclosed but the deposit carriage has a width which corresponds to the width of the point of deposit. The point of deposit can be formed as a pallet, a lifting table, a cardboard container, or the like. For each deposit carriage a point of deposit is provided onto which depositing is possible in the longitudinal direction and in the transverse direction. Depositing in the longitudinal direction is realized by the traversability of the deposit carriage in the longitudinal direction. Depositing in the transverse direction is realized by the fact that the material web, if it is narrower than the width of the deposit rollers, is moved over them in the transverse direction. For this, a material web supply device is equipped to be correspondingly traversable in the transverse direction. The device known from DE 101 25 452 C2, which in fact discloses a secured material web supply by means of a transport belt, requires, due to the width of the deposit carriage corresponding to the deposit width, a very extensive and massive form of construction. Such a form of construction entails larger masses having to be accelerated, therefore powerful drives are used, which from the viewpoint of construction and in regard to the power required is naturally associated with high costs. Furthermore, large, heavy forms of construction are always at the expense of the production rate.

An additional device for laying a flexible material web follows DE 298 23 580 U1. Also in the case of this device, a pair of deposit rollers rotating in opposite directions is provided, via which the material web is supplied to a point of deposit. The deposit rollers from DE 298 23 580 U1 are however not a part of a deposit carriage and have the same width as the point of deposit and are furthermore also not traversable in the transverse direction.

From DE 44 38 770 A1 the next device is known in which the accommodation of yarn take-up rolls or the assembly of winding machines with yarn take-up rolls is involved. This device has a storage device to accommodate these rolls. It is therefore a storage device in which rolls are stored. DE 196 44 383 C1 is concerned with a pivotable deposit arm, not with deposit rollers.

Starting from the state of the art known from U.S. Pat. No. 6,155,551, the objective of the invention is to provide a device which is of the type under discussion and makes possible a higher production rate with a secure transport of the material web to the deposit carriage.

SUMMARY OF THE INVENTION

The above and other objects and advantages of the present invention are achieved by the provision of a device of the type under discussion, wherein the material web is transported on a transport belt running around the deposit rollers of the deposit carriage, and wherein a path compensation carriage working together with the deposit carriage is provided whose width is less than that of the point of deposit.

Starting from U.S. Pat. No. 6,155,551 it has been recognized that the free and unguided supply of the material web can lead to faulty stacks. According to the invention it has been recognized that a secure transport of the material web can be achieved if it is transported to the point of deposit on a transport belt which runs around the deposit rollers of the deposit carriage. During laying on the transport belt a twisting of the material web on the way to the deposit carriage is prevented. Furthermore, it has been recognized that the device achieves a higher production rate if the path compensation carriage provided to compensate for the reciprocating motion of the deposit carriage has a smaller width than the point of deposit. Due to the width of the path compensation carriage being smaller than the point of deposit, mass and size are reduced and material as well as operating energy are saved.

If a light form of construction with small dimensions can be traversed in the longitudinal and transverse directions, the possibility is also opened of traversing to several points of deposit with one deposit carriage and supplying successive points of deposit with the material web. The enormous advantage of the device according to the invention and movable in the longitudinal and transverse direction lies in the flexible filling of points of deposit with low operating costs and little expenditure in construction. It is expressly emphasized that the device or the deposit carriage not only makes possible traversing in the longitudinal and transverse directions in the area of a single point of deposit but rather, beyond this, also traversing to several points of deposit which are disposed so as to be adjacent and/or sequential.

With regard to construction the deposit carriage could be a component of the frame which is disposed so as to be traversable on a rack in the transverse direction. It is particularly advantageous if the deposit carriage would in addition to this be adjustable in height since then a lifting table can be omitted. Through the adjustability in height of the deposit carriage, regulation and control processes could be realized in a simpler manner than in the case of adjustment of an external lifting table. Also here, the deposit carriage could be a component of the frame and the frame could be traversed, e.g., on vertical columns of the rack.

An additional embodiment, advantageous in another regard, of the device according to the invention, where lifting tables are used, provides that the deposit carriage supplies two points of deposit with the material web. As soon as a stack is formed the deposit carriage can be traversed to the next point of deposit and begin the depositing process there. In this way longer idle times can be avoided. Merely a cutting process for separating the material web after attaining the desired stack height is required. The cutting process could be carried out so that the new belt's start toward the deposit carriage is already underway.

With regard to high production rates it is furthermore very advantageous if the device according to the invention has hold-down means for the uppermost deposited material web. The hold-down means could extend parallel to the deposited material web, contact it in the area of the uppermost deposited material web, and thus hold it down. Through the contact of the hold-down means with the uppermost deposited material web, the effects of wind, air turbulence, or similar effects, as well as undesired elastic recovery in the case of elastic material webs such as fibrous material webs, can be largely ruled out, above all in the case of light materials with a weight under 60 g/m$^2$. In order to produce contact to the extent desired, the point of deposit could be adjustable in height and/or also the hold-down means themselves, which are then to be coordinated in their movement, in particular to the height adjustment of the deposit carriage. By exerting a certain pressure during the contacting not only can the positional security of the uppermost layer be realized but in addition to this a predeterminable force of compression could also be exerted in order, for example, to reduce the volume of the stack and thus provide more material for packaging. The contacting under discussion makes possible the laying of the material web at higher rates, in particular at rates over 200 m/minute.

The hold-down means could comprise at least one hold-down roller. So that the entire uppermost material web is gripped on both sides by the material web exiting from the deposit rollers, two hold-down rollers could roll off on the surface of the stack on both sides of the deposit carriage. The pair of hold-down rollers would then be traversable with the deposit carriage in the transverse direction. With regard to the arrangement from the standpoint of construction, the hold-down rollers could extend from one end face of the rack to the other and rotate as well as traverse in the transverse direction.

Alternatively to the hold-down rollers, which with a smaller roller diameter are only temporarily in contact with smaller sections of the uppermost layer of the material web stack, at least one separate hold-down belt could be provided as the hold-down means. Also conceivable would be two hold-down belts which extend to both sides of the deposit carriage and work together with corresponding holding and clamping devices. Each of the two hold-down belts could be disposed to both sides of the deposit carriage or also in front of and behind it. The fastening could also be done on the frame in which the deposit carriage and the transport belts are disposed, or also via reversing rollers. The running direction of the two hold-down belts can be in the longitudinal direction parallel to the deposit length or in the transverse direction parallel to the deposit width. In regard to traversability in both the longitudinal direction and the transverse direction beyond the area of a single point of deposit, the hold-down belt or belts could span the entire surface which is predefined by the rack of the device. A particularly advantageous embodiment provides only one hold-down belt which extends at least over the point of deposit both in the longitudinal direction and in the transverse direction and runs around it in the transverse direction. The hold-down belt could be guided via reversing rollers which are disposed on the longitudinal sides of the rack, extend in the longitudinal direction, and run around it in the transverse direction. So that the material web arrives at the point of deposit in the preferred embodiment with a single hold-down belt running around, this hold-down belt could comprise a penetrating opening for the material web, which is always disposed synchronously to the position of the deposit carriage or to the exit side of the material web from the deposit rollers.

There could be additional hold-down means in the form of a lamellar wall, a guide plate, or a profile which all exert a more or less great force of compression of the stack via the uppermost layer of the deposited material web.

The supply of the material web to the deposit carriage could be accomplished via a material web supply device disposed in front of the deposit rollers, said material web supply device comprising a rotary storage device which, due to its storage function, compensates the varying need for material web supply due to the reciprocating motion of the deposit carriage. The change in length of the material web caused by the change of direction during the back and forth motion demand different material web supply rates. In order to realize this, the rotary storage device could be driven and for this comprises a motor which is part of the entire drive system of the device and is thus synchronized to the position of the deposit carriage. The driven synchronous compensation of a reversing process by the rotary storage device leads to a quiet and uniform material web supply. The idea of the above-described rotary storage device can also find application even in depositing processes in which the reciprocating motion has little or no significance.

According to a preferred embodiment of the device according to the invention, the material web could also be transported to the deposit rollers between two transport belts. The advancing speed of the material web during transport on the transport belt or between two transport belts could be equal to the advancing speed of the transport belt or belts. During transport between two transport belts, they could form a pressure zone, whereby a substantially seamless supply of the material web between two transport belts is achieved, where the material web lies on one transport belt and is covered by the other. In this way it is ruled out on the one hand that the material web slips and on the other hand that the material web is contaminated or otherwise exposed to external influences. The equality of the speed of the transport belt to the speed of the material web transported on the transport belt entails the advantage that electrostatic effects are substantially avoided and the material itself is protected. The reduction of friction is above all of significance in regard to depositing the material web onto the previous layer. The roller or two deposit rollers always roll off on the material web so that a detrimental effect on the position of the previous layer, a draping, a static charge, or even a deterioration of quality cannot occur. Through the use of a deposit carriage it is furthermore caused that the rate of the uppermost layer of the deposited material web, the rate of the material web reaching the uppermost layer, and the rates of the layers one below another are also all equal.

In summary, it is explained that with the device according to the invention a manageable and simple construction for laying material webs is presented which increases the production rates and lowers the production and energy costs. A stack could be prepared on a bearing block. Furthermore, through the adjustability of the height of the deposit carriage, the hold-down means, and the compensation of the reversing processes by a driven rotary storage device, additional embodiments which significantly enrich the invention in themselves have been presented which are conducive to the realization of the objective according to the invention.

There are various possibilities for developing and extending the teaching of the present invention in an advantageous manner. For this, reference is made to the following explanation of several embodiments of the invention with the aid of the drawings. In connection with the explanation of the given embodiments of the invention with the aid of the drawings, developments and extensions of the teaching which are preferred in general are explained.

DETAILED DESCRIPTION OF THE PREFERRED EMBODIMENTS

Figure 1:
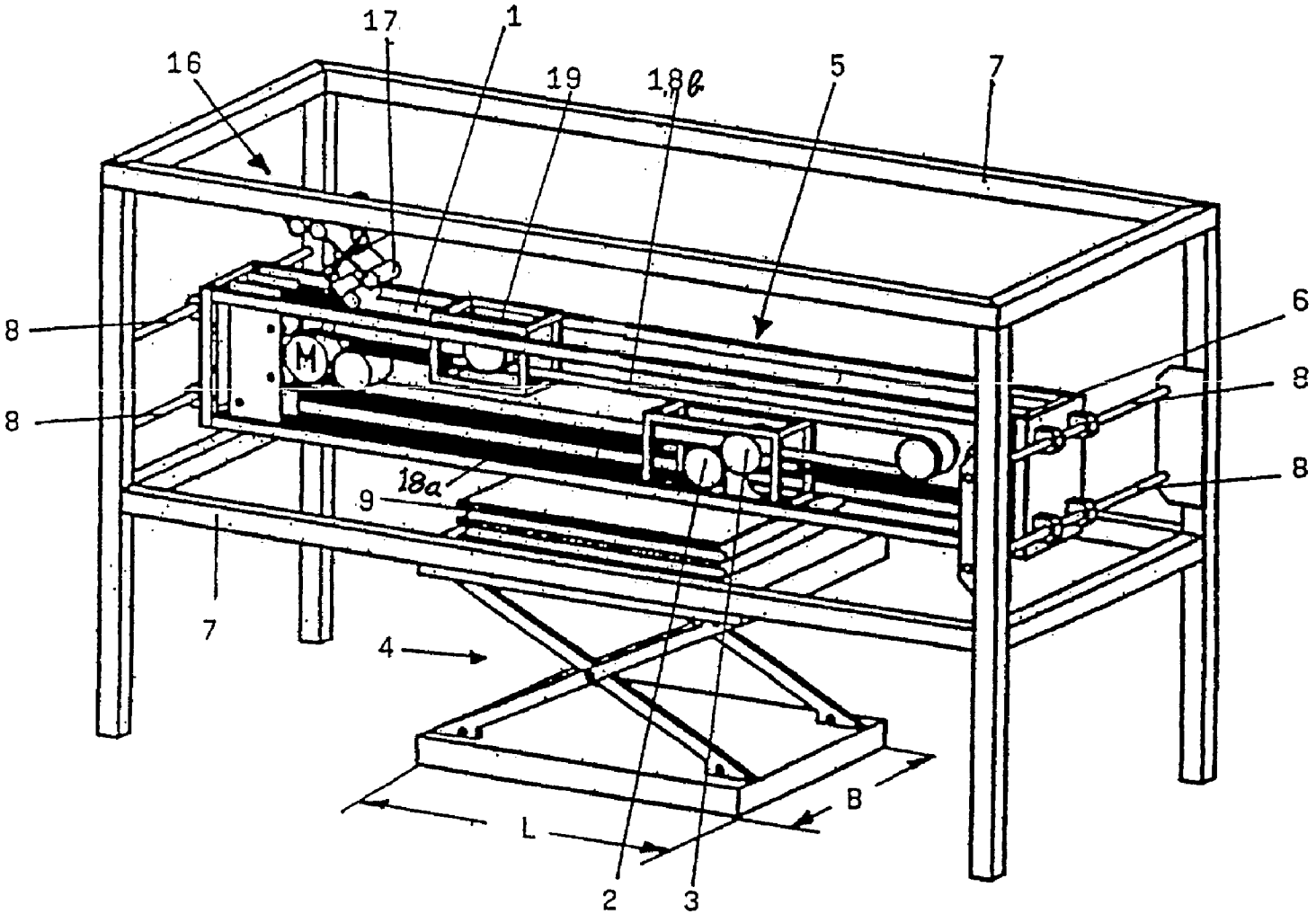
FIG. 1 is a schematic perspective view of a first embodiment of the device according to the invention.

FIGS. 1 to 7 show a device for laying a flexible material web 1 with at least one pair of deposit rollers 2, 3 rotating in opposite directions, where the material web 1 can be supplied to at least one point of deposit 4 by means of the deposit rollers 2, 3. The deposit rollers 2, 3 are a part of the deposit carriage 5 which can be traversed over at least the deposit length L of the material web 1 and with a reversible direction.

The deposit carriage 5 has a smaller width than the point of deposit 4 and can be traversed over the deposit width B of the point of deposit 4 and with a reversible direction. For this, the deposit carriage 5 is a component of a frame 6 which is disposed so that it can be traversed in the transverse direction in a rack 7. The rack 7 comprises on its end faces guide bars 8 extending in the transverse direction, on which the frame 6 is mounted in such a manner that it can be moved.

Figure 2:
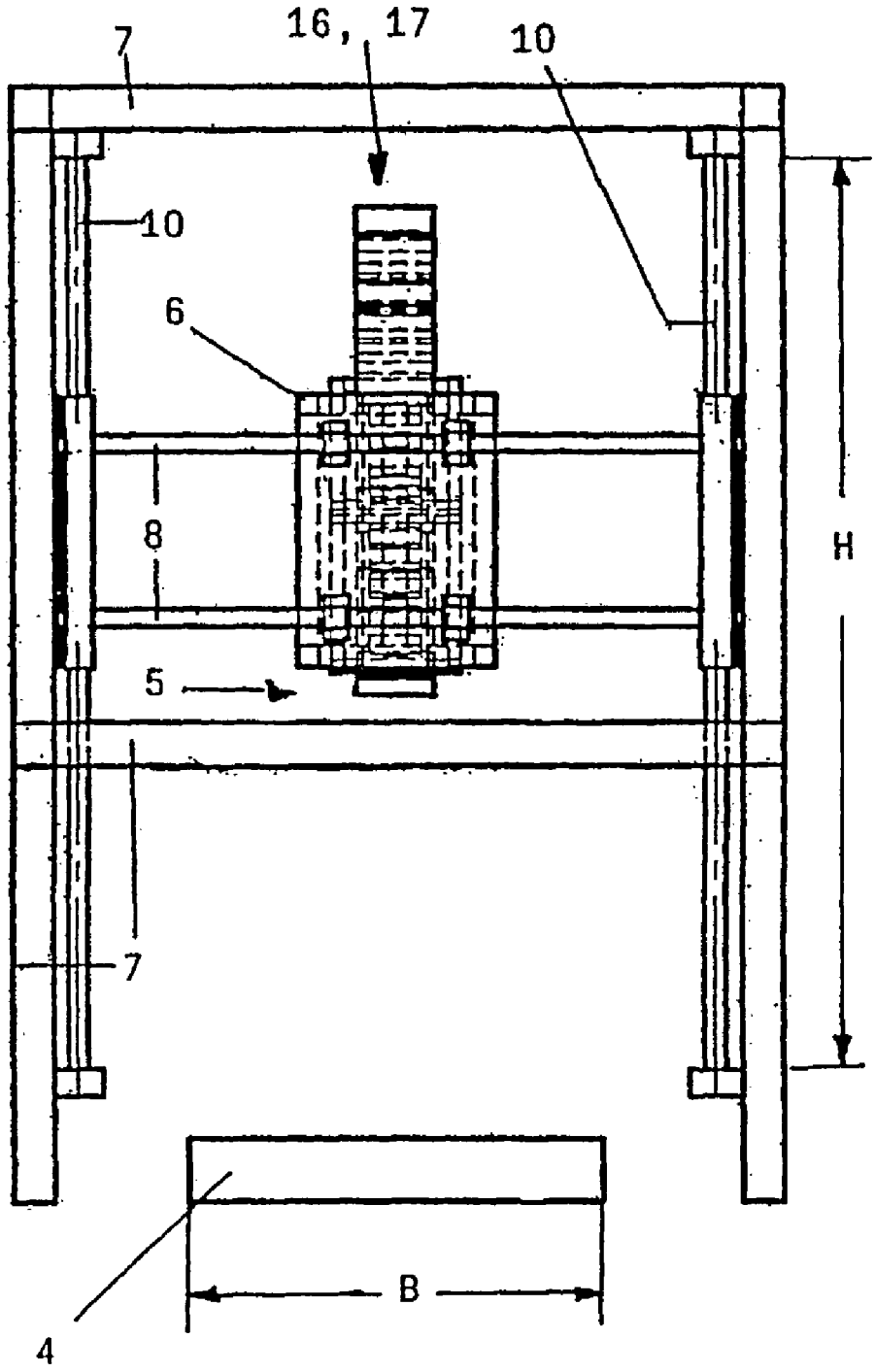
FIG. 2 is a schematic front view of a second embodiment of the device with a deposit carriage which can be adjusted in height.

In FIG. 1, a first embodiment is shown, where the point of deposit 4 is embodied by a lifting table which can be adjusted with regard to its height and is traversed downwards as the stack 9 grows. In FIG. 2, not the point of deposit 4 but rather the deposit carriage 5 can be adjusted with regard to its height H. Disposed on the rack 7 for the height adjustment are vertical guide bars 10 for the frame 6, with which the deposit carriage 5 can be traversed into the suitable position relative to the fixed point of deposit 4.

Figure 3:
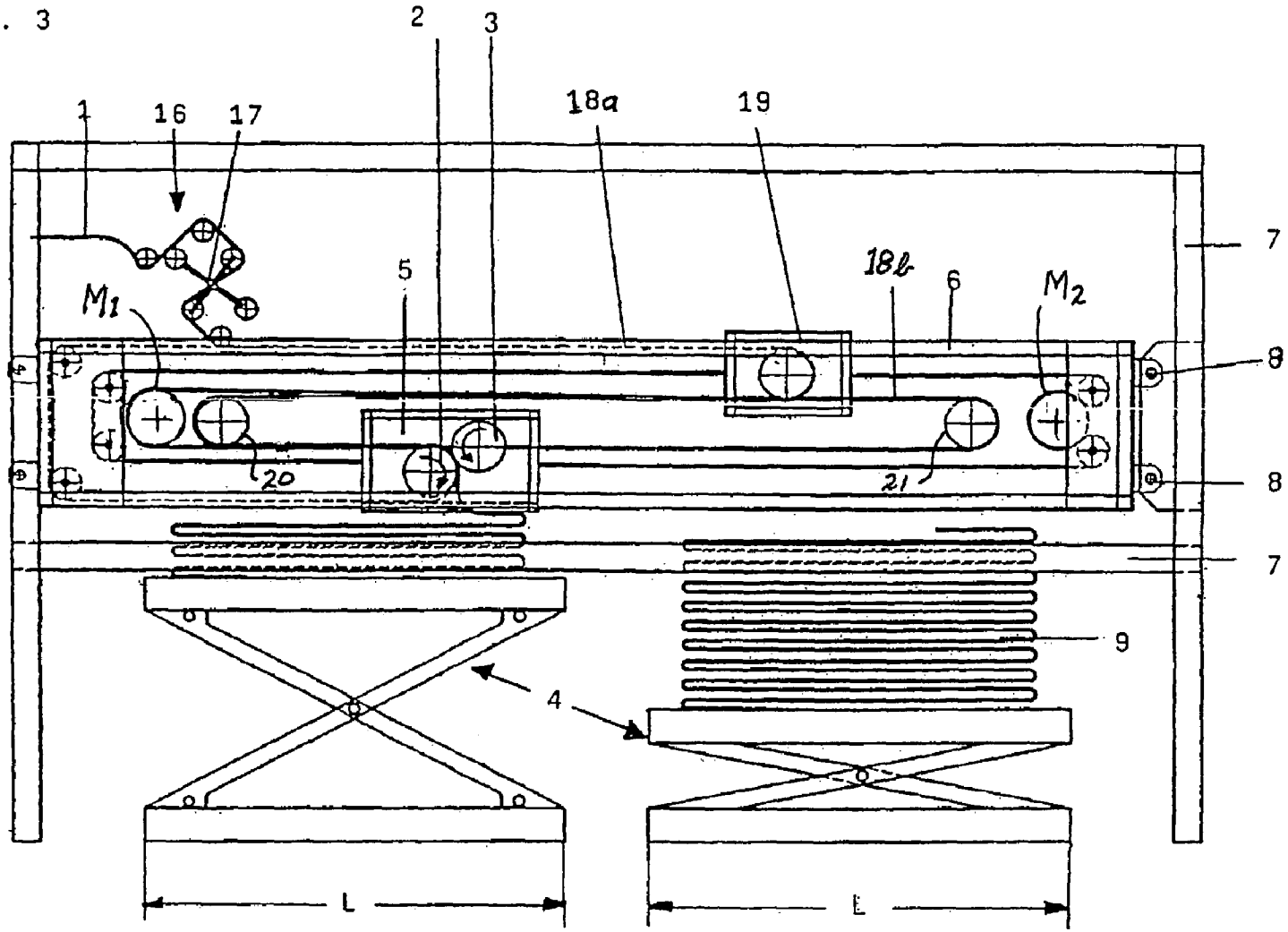
FIG. 3 is a schematic side view of a third embodiment of the device according to the invention with two points of deposit.

From FIG. 3 a third embodiment of the device according to the invention is shown, where two points of deposit 4 are assigned to the deposit carriage 5. In this third embodiment the deposit carriage 5 can be traversed over both deposit lengths L and supplies in succession one point of deposit 4 after another with the material web 1 without protracted interruption.

FIGS. 4 to 7 represent the situation in which, according to a fourth and fifth embodiment, two types of means for holding down the uppermost deposited material web 1 are provided.

Figure 4:
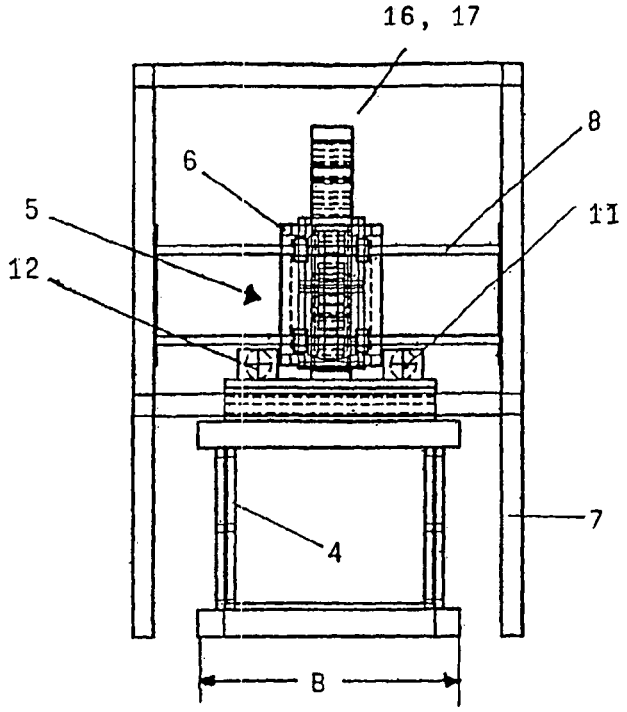
FIG. 4 is a schematic front view of a fourth embodiment of the device according to the invention with hold-down rollers.
Figure 5:
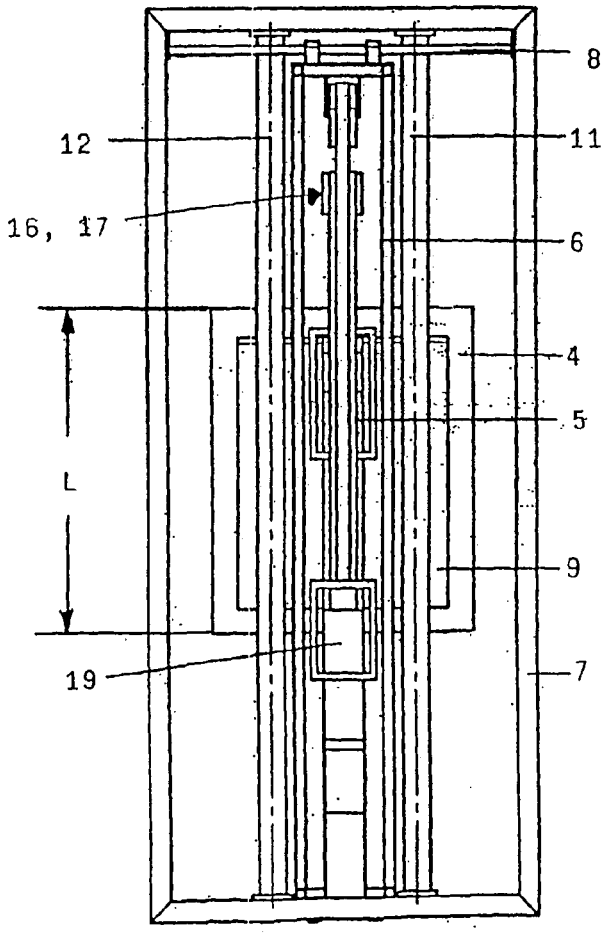
FIG. 5 is a schematic plan view of the device of FIG. 4.

According to FIGS. 4 and 5 the hold-down means comprise a pair of hold-down rollers 11, 12. The hold-down rollers 11, 12 extend approximately from one end face of the rack 7 to the other and can be traversed in the transverse direction together with the deposit carriage 5, where each of the hold-down rollers 11, 12 here clearly projects beyond the deposit width B at the reversing point of the deposit carriage 5.

Figure 6:
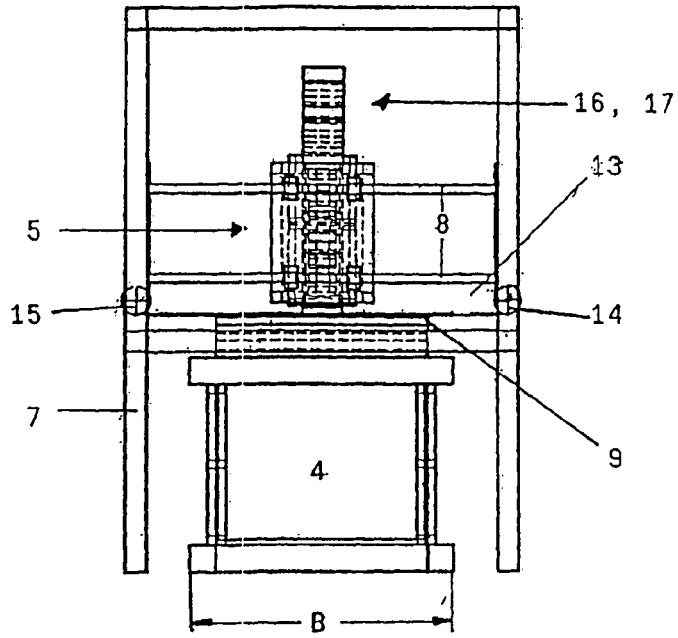
FIG. 6 is a schematic front view of a fifth embodiment of the device according to the invention with a hold-down belt.
Figure 7:
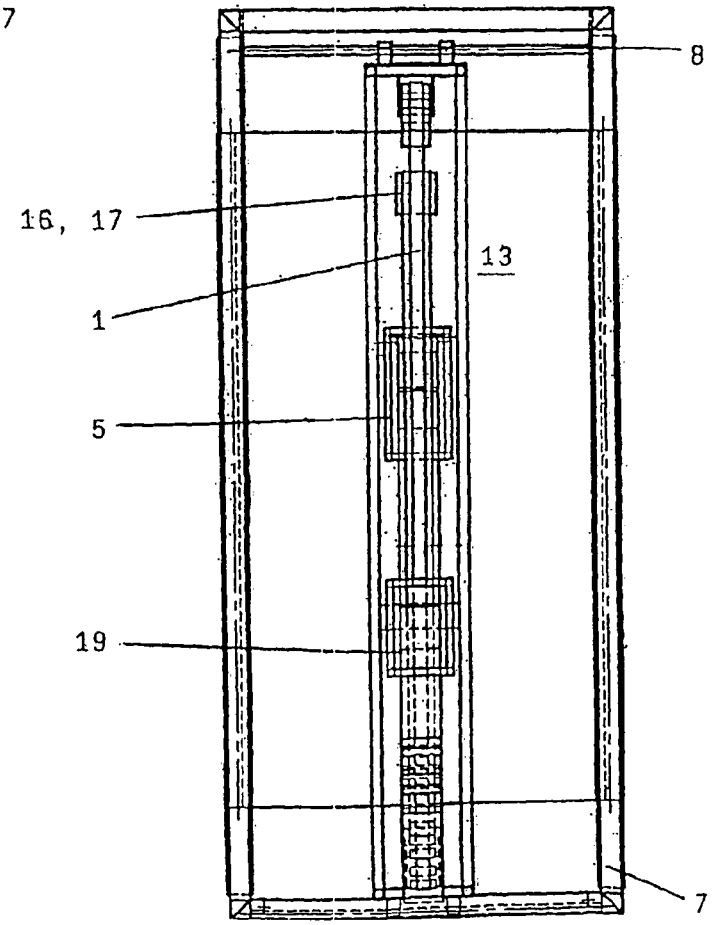
FIG. 7 is a schematic view of the device of FIG. 5.

A hold-down belt 13 is represented in FIGS. 6 and 7 which in the transverse direction runs around reversing rollers 14, 15 over the entire area of the rack 7. The hold-down belt 13 extends over the deposit length L and the deposit width B of the point of deposit 4 and, in each case at the current height of the uppermost layer of the deposited material web 1 or the stack 9, extends from one end face of the rack 7 to the other.

The hold-down belt 13 comprises a penetrating opening not represented in more detail which is disposed continuously synchronously to the position of the deposit carriage 5 or to the exit point of the material web 1 from the deposit rollers 2, 3.

Particularly from FIGS. 1 and 3, it follows that the material web 1 can be supplied via a material web supply device 16 disposed in front of the deposit rollers 2, 3, where the supply device comprises a rotary storage device 17. The rotary storage device 17 is driven and a motor, which is not represented, is provided which is a part of the entire drive system of the device and thus is synchronized to the position of the deposit carriage 5. In performing its storage function, the rotary storage device 17 compensates for the demand for the material web 1, said demand varying as a consequence of the reciprocating motion.

Two transport belts 18*a* and 18*b* are provided for advancing the material web 1 to the deposit carriage 5. The belts 18*a* and 18*b* are best seen in FIG. 3, which shows the transport belt 18*a* looping about the roller of the path compensation carriage 19, about the motor $M_1$, about the roller 2 of the deposit carriage 5, and then over a pair of idler rollers and back to the path compensation carriage. The belt 18*b* loops about a pair of rollers 20, 21 and includes an upper run which underlies a segment of the belt 18*a*, and a lower run which overlies a segment of the belt 18*a* immediately upstream of the roller 2.

In operation, the material web 1 is deposited upon the belt 18*a* by the web supply device 16 and so that the deposited web loops about the roller of the path compensation carriage 19 and is deposited upon the belt 18*b* so as to be transported between the two belts which form a pressure zone. Thus the advancing speed of the material web is equal to the advancing speed of the two belts. Next, the material web 1 loops with the belt 18*b* about the roller 20, and then again is transported between the two belts to the deposit carriage 5.

Furthermore, FIG. 3 shows two motors which are denoted by $M_1$ and $M_2$. The motor $M_1$ adjacent to the material web supply device 16 drives the transport belts 18*a* and 18*b* and the opposite motor $M_2$ drives the deposit carriage 5 and the path compensation carriage 19, so that the deposit carriage is reciprocated and the path compensation carriage 19 is reciprocated in the opposite direction and thus compensates for the reciprocating motion of the deposit carriage and maintains the length of the belt 18*a*.

With regard to additional features not shown in the figures reference is made to the general part of the description.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A device for laying a flexible material web onto at least one point of deposit which has a deposit length L and a deposit width B, comprising a deposit carriage, means mounting the deposit carriage to a supporting rack for reciprocation over the deposit length L of the one point of deposit and for transverse reciprocation over the deposit width B of the one point of deposit, with said deposit carriage mounting at least one pair of deposit rollers which rotate in opposite directions and act to deliver the material web onto the at least one point of deposit, wherein the deposit carriage has a smaller width than the width B of the one point of deposit, a transport belt for transporting the material web along a path of travel to the deposit rollers, and a path compensation carriage positioned in the path of travel of the transport belt, with the path compensation carriage having a width which is less than the width B of the one point of deposit.

2. The device according to claim 1, wherein the deposit carriage is a component of a frame which is mounted to the supporting rack in such a manner that it can be transversely reciprocated.

3. The device according to claim 1, wherein the mounting means is configured such that the deposit carriage is adjustable in height.

4. The device according to claim 1, wherein the deposit carriage is configured to selectively overlie two points of deposit.

5. The device according to claim 1, further comprising hold-down means for overlying the uppermost deposited material web on the one point of deposit.

6. The device according to claim 5, wherein the hold-down means is adjustable in height.

7. The device according to claim 5, wherein the hold-down means comprises at least one hold-down roller.

8. The device according to claim 5, wherein the hold-down means comprises a pair of hold-down rollers which are translatable with the deposit carriage in the transverse direction, at least over the deposit width B.

9. The device according to claim 5, wherein the hold-down means comprises at least one hold-down belt.

10. The device according to claim 9, wherein the hold-down belt extends at least over the one point of deposit.

11. The device according to claim 10, wherein the hold-down belt comprises a penetrating opening which is always disposed synchronously to the position of the deposit carriage or to the exit side of the material web from the deposit rollers.

12. The device according to claim 1, wherein the material web is supplied via a material web supply device disposed upstream of the deposit rollers, and wherein the material web supply device comprises a rotary storage device.

13. The device according to claim 12, wherein the rotary storage device is driven and for this comprises a motor which is part of the entire drive system of the device and is thus synchronized to the position of the deposit carriage.

14. The device according to claim 1, wherein the material web is transported at least partly to the point of deposit between two transport belts, which form a pressure zone, and that the advancing speed of the material web is equal to the advancing speed of the transport belts.

15. A device for laying a flexible material web onto at least one point of deposit which has a deposit length L and a deposit width B, comprising a deposit carriage, means mounting the deposit carriage to a supporting rack for reciprocation over the deposit length L of the one point of deposit and for transverse reciprocation over the deposit width B of the one point of deposit, with said deposit carriage mounting at least one pair of deposit rollers which rotate in opposite directions and act to deliver the material web onto the at least one point of deposit, a first transport belt for transporting the material web along a path of travel to the deposit rollers and so as to loop about one of the deposit rollers of the deposit carriage, a material web supply device for depositing the material web upon the first transport belt, a second transport belt mounted so as to define at least one segment which is contiguous to the first transport belt so that the material web is transported in a pressure zone formed between the two transport belts, and a drive motor for advancing the first and second transport belts at the same advancing speed.

16. The device according to claim 15, further comprising a path compensation carriage positioned in the path of travel of the first transport belt so as to compensate for the reciprocating motion of the deposit carriage and maintain a constant length of the first transport belt.

17. The device according to claim 16, wherein the deposit carriage and the path compensation carriage are reciprocated in relative opposite directions by a second drive motor.

18. The device according to claim 17, wherein the deposit carriage and the path compensation carriage are mounted on a frame which is in turn mounted to the supporting rack for transverse reciprocation with respect to the rack.

19. The device according to claim 18, wherein the width of the deposit carriage and the width of the path compensation carriage are each less than the width of the point of deposit.

20. The device according to claim 15, wherein the material web supply device includes a rotary storage device which is driven so as to be synchronized to the position of the deposit carriage and thereby compensate for the varying demand resulting from the reciprocating motion of the deposit carriage.

* * * * *